US008608099B2

(12) United States Patent
Tobler et al.

(10) Patent No.: US 8,608,099 B2
(45) Date of Patent: Dec. 17, 2013

(54) HAMMER MILL, ROTOR OF A HAMMER MILL, HAMMER PINS, CATCH DEVICE AND FIXING DEVICE

(75) Inventors: Marco Tobler, St. Gallen (CH); Walter Hablützel, Winterthur (CH)

(73) Assignee: Bühler AG, Uzwil (CH)

( * ) Notice: Subject to any disclaimer, the term of this patent is extended or adjusted under 35 U.S.C. 154(b) by 0 days.

(21) Appl. No.: 13/521,826

(22) PCT Filed: Jan. 7, 2011

(86) PCT No.: PCT/EP2011/050159

§ 371 (c)(1),
(2), (4) Date: Jul. 12, 2012

(87) PCT Pub. No.: WO2011/086035

PCT Pub. Date: Jul. 21, 2011

(65) Prior Publication Data

US 2012/0286082 A1 Nov. 15, 2012

(30) Foreign Application Priority Data

Jan. 15, 2010 (EP) ..... 10150863

(51) Int. Cl.
*B02C 13/28* (2006.01)

(52) U.S. Cl.
USPC ..... 241/194; 241/189.1; 241/195; 241/197; 241/294

(58) Field of Classification Search
USPC ..... 241/189.1, 194, 195, 197, 294
See application file for complete search history.

(56) References Cited

U.S. PATENT DOCUMENTS

| | | | | | |
|---|---|---|---|---|---|
| 3,346,201 | A * | 10/1967 | Butler, Sr. | ..... | 241/189.1 |
| 4,504,019 | A * | 3/1985 | Newell et al. | ..... | 241/73 |
| 6,412,718 | B1 * | 7/2002 | Kohl et al. | ..... | 241/194 |
| 7,325,761 | B2 * | 2/2008 | Chen et al. | ..... | 241/194 |
| 7,419,104 | B2 * | 9/2008 | Roman | ..... | 239/155 |
| 7,559,497 | B2 * | 7/2009 | Young | ..... | 241/194 |
| 2009/0159732 | A1 * | 6/2009 | Zollig | ..... | 241/194 |

FOREIGN PATENT DOCUMENTS

| | | | | | |
|---|---|---|---|---|---|
| CN | 101 549 310 | | 10/2009 | | |
| DE | 24 36 338 | | 2/1976 | | |
| DE | 102 53 345 | | 5/2004 | | |
| EP | 0 015 197 | | 9/1980 | | |
| EP | 0015197 | A1 * | 9/1980 | ..... | B02C 13/282 |
| GB | 1493847 | A * | 11/1977 | ..... | B02C 13/28 |
| GB | 2 017 532 | | 10/1979 | | |
| JP | 2008000656 | A * | 6/2006 | ..... | B02C 13/28 |
| JP | 2008 000656 | | 1/2008 | | |
| JP | 2008000656 | A * | 1/2008 | ..... | B02C 13/28 |

* cited by examiner

*Primary Examiner* — Dana Ross
*Assistant Examiner* — Onekki Jolly
(74) *Attorney, Agent, or Firm* — Shoemaker and Mattare

(57) ABSTRACT

A hammer mill has a lockable milling chamber and a rotor disposed in the milling chamber. The rotor has a shaft supporting plural rotor discs and plural hammer pins for receiving hammers or hammer assemblies. The hammer pins do not extend over all the segments defined by the discs.

14 Claims, 8 Drawing Sheets

HAMMER MILL, ROTOR OF A HAMMER MILL, HAMMER PINS, CATCH DEVICE AND FIXING DEVICE

Figure 1:
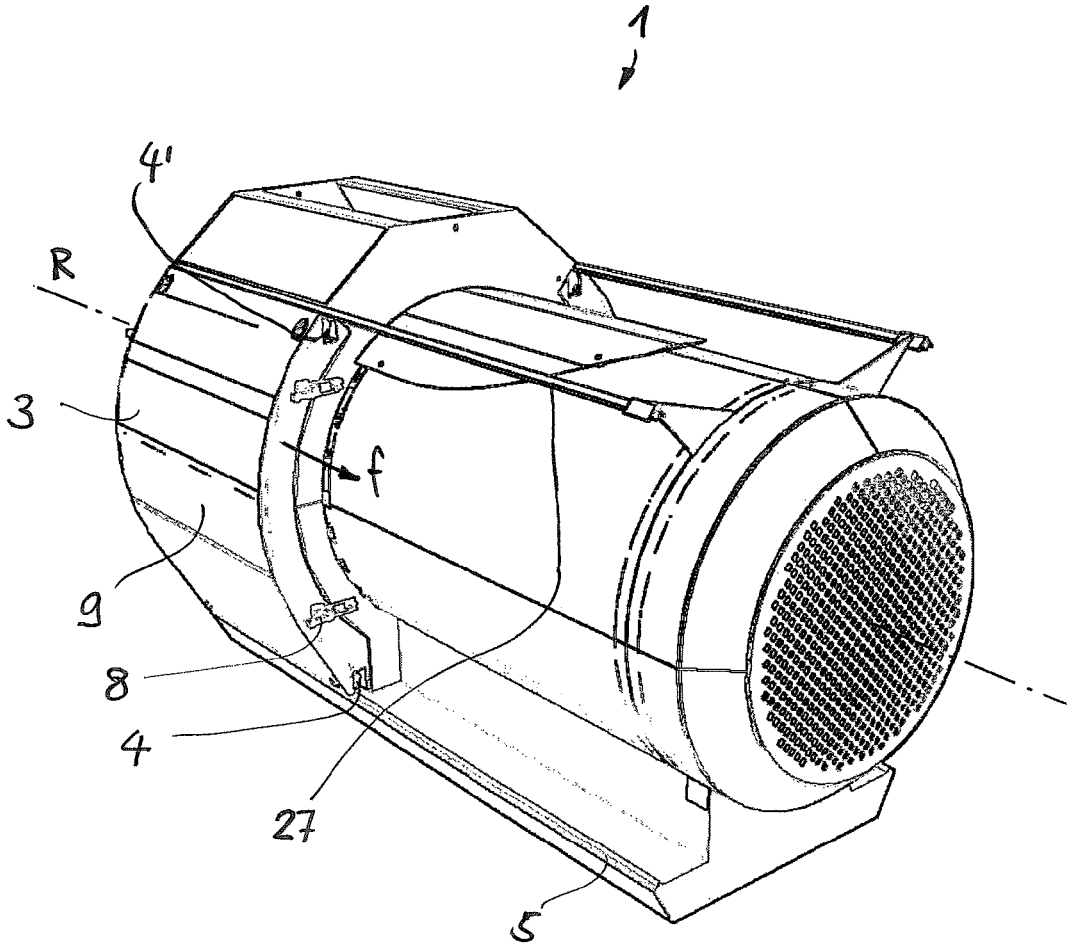

The present invention relates to a hammer mill, a rotor of a hammer mill, a hammer pin, a catch device and a fixing device.

Hammer mills have long been known from the prior art.

For example, DE 102 53 345 A1 discloses a hammer mill, in which servicing is facilitated. In particular, the replacement of the hammers is simplified, since these can be mounted directly on the rotor in a module. The hammers and their spacers are arranged in a line in a template. A hammer pin is then introduced through all lined-up hammers and spacers. The module prefabricated in this manner is then transferred to the rotor in the template and the hammer pin is fixed in the rotor at the rotor discs.

The hammer mills from the prior art have the disadvantage that replacement of an individual damaged or worn hammer is associated with considerable effort. A large number of hammers arranged in front of the hammer to be replaced always have to be removed.

The object of the invention is to overcome the disadvantages of the prior art. In particular, a hammer mill is to be provided which enables simple and quick replacement of the hammers.

This object is achieved by the hammer mill, the rotor and the hammer pin according to the independent patent claims. Further embodiments will emerge from the dependent patent claims.

A hammer mill according to the invention has a grinding chamber, which can be closed during normal use, and a rotor arranged in the grinding chamber. This rotor comprises a rotor shaft and a plurality of rotor discs, which divide the rotor into a plurality of segments. The rotor discs can be arranged on the rotor shaft at uniform or variable distances from one another. For example, the individual rotor discs can be fixed on the rotor shaft by a screwed connection. The rotor has a plurality of hammer pins for receiving hammers or entire hammer assemblies. The individual hammer pins do not extend over all segments.

Since the individual hammer pins do not reach over all segments, it is thus possible to replace the hammers or the hammer assemblies in a simple manner. Compared to a conventional design, the hammer pin is much shorter and lighter and receives fewer hammers. The individual hammer pin can be manipulated more easily with its hammers or hammer assemblies arranged on the hammer pin.

The hammer pins may also be rotationally symmetrical, which considerably simplifies the assembly of the hammer pins further still. In particular, correct orientation of the hammer pins does not have to be considered.

The individual hammer pins can be fastened releasably on both sides to opposite rotor discs defining an individual segment. If an individual hammer pin only reaches over an individual segment, the hammer pin can be made shorter and replacement of an individual hammer or of an individual hammer assembly is simplified further.

Openings in the rotor discs, which can receive the hammer pins, may have an inner diameter which is greater than an outer diameter of the hammer pin. The hammer pin therefore has to be withdrawn completely or in part merely from one opening in the rotor disc. A partially withdrawn hammer pin can then be removed from the segment by being tilted. The opening in the rotor disc is large enough that tilting of the hammer pin is enabled, whereby the hammer pin can be moved past an adjacent rotor disc.

It has proven to be advantageous if the hammer pins of a segment are arranged circumferentially so as to be offset from the hammer pins of an adjacent segment. The hammer pins can thus be released and withdrawn more easily.

One or more support rings may be arranged between each two adjacent rotor discs. Such a support ring, which likewise has openings, through which the hammer pin passes or is passed, is used in particular to provide additional support for the hammer pin. In particular at high rotational speeds, the hammer pins are highly stressed by the weight of the hammers and by the rotation of the rotor. The hammer pins can be made accordingly smaller due to the use of support rings.

The support rings can be connected to the rotor discs by means of support pins. Such a connection of the support rings to the rotor discs results in additional stability of the rotor. The support pins may be continuous over all rotor discs. A simple construction is possible as a result of such support pins extending over all rotor discs.

Each hammer pin between each two adjacent support rings or between a support ring and an adjacent rotor disc can receive at least one or more hammers. The number of hammers is determined by the desired type of grinding, the rotational speed, the mass of the individual hammers, and by rotor diameter.

Each hammer pin may be provided at a first end with a cap for fastening the hammer pin in an opening in a rotor disc. Due to the use of a cap which connects the hammer pins to the rotor disc, a simple and cost-effective construction of the fastening is possible. Such a cap may be a metal component, which can be produced in a particularly simple manner by milling and/or turning operations.

The cap may have a substantially cylindrical shape, of which the outer diameter corresponds substantially to the inner diameter of the openings in the rotor discs. The cap is thus received or can be received in the respective opening in the rotor disc with an accurate fit. Stable fixing of the hammer pins at the rotor discs can thus be ensured. Due to the use of caps of this type, the assembly and disassembly of the hammer pins can also be simplified further. The cylindrical receiving portion of the cap assigned to the opening may define an annular gap, which determined the tilt angle for disassembly of the hammer pin. At one end, the cap preferably has a shoulder, for example formed by a circumferential collar, said shoulder serving as a stop in the opening in the rotor disc. At the opposite end, the cap may have a bore so as to receive the hammer pin therein. For example, the bore may have an inner thread, into which the hammer pin, which has a corresponding outer thread at one end, is screwed. It is also conceivable for the cap to be fastened to the hammer pin by means of a separate screw. Alternative forms of the fastening are also conceivable. In addition, the cap can be formed in one piece together with the hammer pin.

So as to secure the cap in the rotor disc, the cap may have a groove for example. This groove can receive a snap ring so that the cap can be fastened securely between the shoulder and snap ring in an opening in the rotor disc. Alternative forms for securing the cap in the rotor disc are conceivable.

It is also conceivable for the hammer pin to have a second cap at its second end, said second cap being fixedly connectable for example to the rotor disc. The hammer pin may then have a groove at its second end, said groove receiving a snap ring. If the second cap has a corresponding groove in its bore to receive the hammer pin, the hammer pin can be fastened easily in the rotor by being inserted into the second cap and by fitting the snap ring both into the groove in the cap and into the groove in the hammer pin.

"Rakes" can be used to position the hammers during assembly thereof and also during operation of the hammer mill, said rakes being installed between the rotor discs. Such a rake has slits on the side facing the hammer pin, the hammers being guided into said slits. The rake is brought close enough to the hammer pin or to the opening in the rotor disc for receiving the hammer pin that the hammers are always engaged with the slits. The hammers are thus indeed mounted rotatably, but fixedly, on the hammer pin. The rake can be installed as an individual component directly between two or on two adjacent rotor discs. Alternatively, it is also conceivable for the rake to form a hammer assembly together with the hammers and a hammer pin, said hammer assembly being fixed between the rotor discs.

It has been found that a catch device is advantageously used for simple hammer replacement and catches the released hammers when a hammer pin is withdrawn. It is thus possible to prevent loose hammers from falling into the grinding chamber, from where they can only be removed with considerable effort. Such a catch device according to the invention for catching hammers of a rotor of a hammer mill, but which cannot just be used in a hammer mill as described above, has a trough-shaped catch chamber and fastening elements. The trough-shaped catch chamber is used to receive loose hammers during assembly and/or disassembly thereof. The fastening elements make it possible to fasten the catch device to a rake between two rotor discs. The fastening elements may be hook-shaped. However, it is also conceivable for the fastening elements to be formed as clips, which can be clipped directly onto the rotor discs. Alternative fastening elements are conceivable. For example, the catch device may consist of a bent sheet metal part. Handles can be arranged on the catch device for easier operation.

It has been found that, in high-quality hammer mills in which the rotor is rotatable without resistance, even the removal of a single hammer leads to rotation of the rotor. This means that hammer replacement always has to be carried out by at least two people, wherein the first person holds the rotor and the second person carries out the actual hammer replacement. If the rotor of a hammer mill is locked in place using a fixing device, the second person is thus no longer required. A corresponding fixing device according to the invention, which cannot just be used in a hammer mill as described above however, has a gripping means, with which the fixing device can be installed fixedly in a hammer mill, for example in the grinding chamber of the hammer mill. In addition, the fixing device has an engagement means, which can be brought from an idle position into a locking position so as to obstruct the movement of the rotor in said locking position. For example, such a fixing device has a hook as a gripping means, with which the fixing device can be hung in the grinding chamber, for example from a wear rail. For example, a clamping plate can be displaced by an elbow lever principle such that the clamping plate presses against a circumferential surface of a rotor disc and thus locks the rotor in place. Other embodiments are also conceivable.

An alternative embodiment of a hammer mill, which is advantageous per se or in combination with the embodiment described above, comprises a grinding chamber with a rotor arranged in the grinding chamber and rotating or rotatable about a rotor axis, and at least one door closing the grinding chamber. The door is mounted displaceably by means of rollers on a roller track arranged parallel to the rotor axis. The rollers are mounted on roller shafts fastened to the door, said roller shafts extending perpendicular to the roller tracks. The rollers can be mounted axially displaceably on these roller shafts between an open position and a closed position. Such rollers mounted displaceably on the roller shafts allow simple and space-saving release of the door of the hammer mill so that it can then be moved easily to the side. This construction offers high stability without great outlay and without the need for a complicated rotating or hinged mechanism.

The rollers can be biased, on the roller shafts, into the open position by a pressing means. Displacement from the closed position is thus facilitated. For example, a spring assembly is a conceivable pressing means.

The door may have additional closing means, which allow displacement of the rollers into the closed position, against the force exerted by the pressing means. Such closing means are a simple tension lever for example. Other closing means are also conceivable.

A rotor according to the invention may have the same features and advantages as described previously with reference to the hammer mill. In particular, it may have hammer pins which do not reach over all segments.

A hammer pin according to the invention for a rotor of a hammer mill is substantially cylindrical. At least at one end, the hammer pin has a means, which allows the hammer pin to be fastened in an opening in a rotor disc of a rotor, either directly or via an additional element. The outer diameter of the hammer pin is smaller than an inner diameter of the opening in which it is to be fastened. Such a hammer pin has the same advantages as described above for the hammer mill and the rotor.

Figure 2:
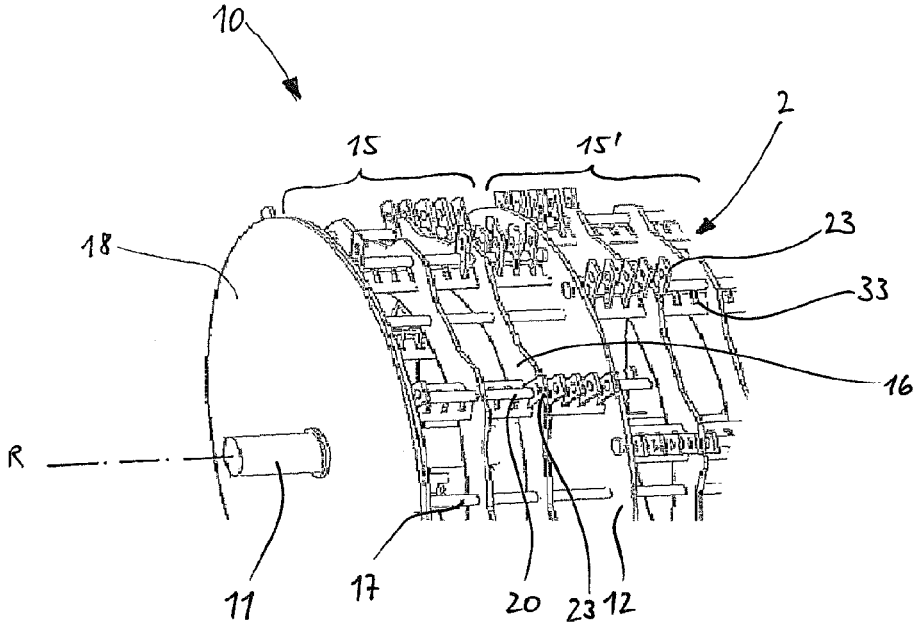
Figure 3A:
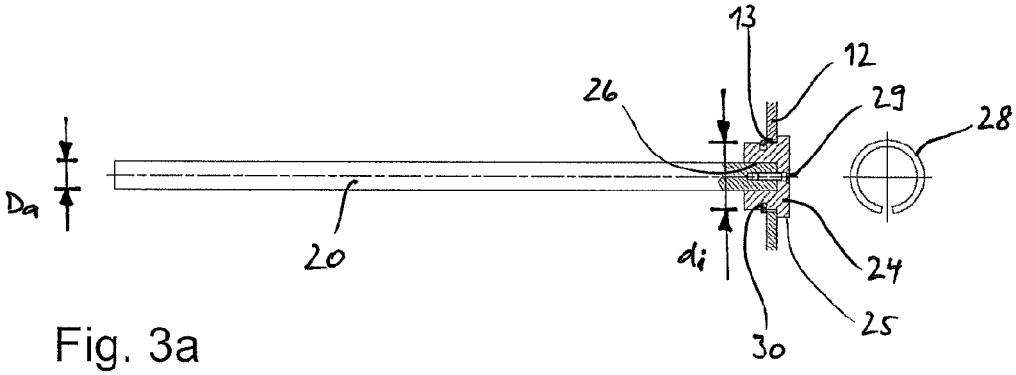
Figure 3B:
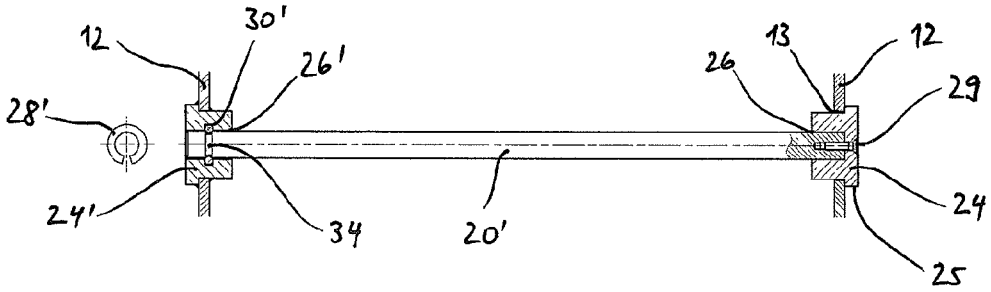
Figure 4:
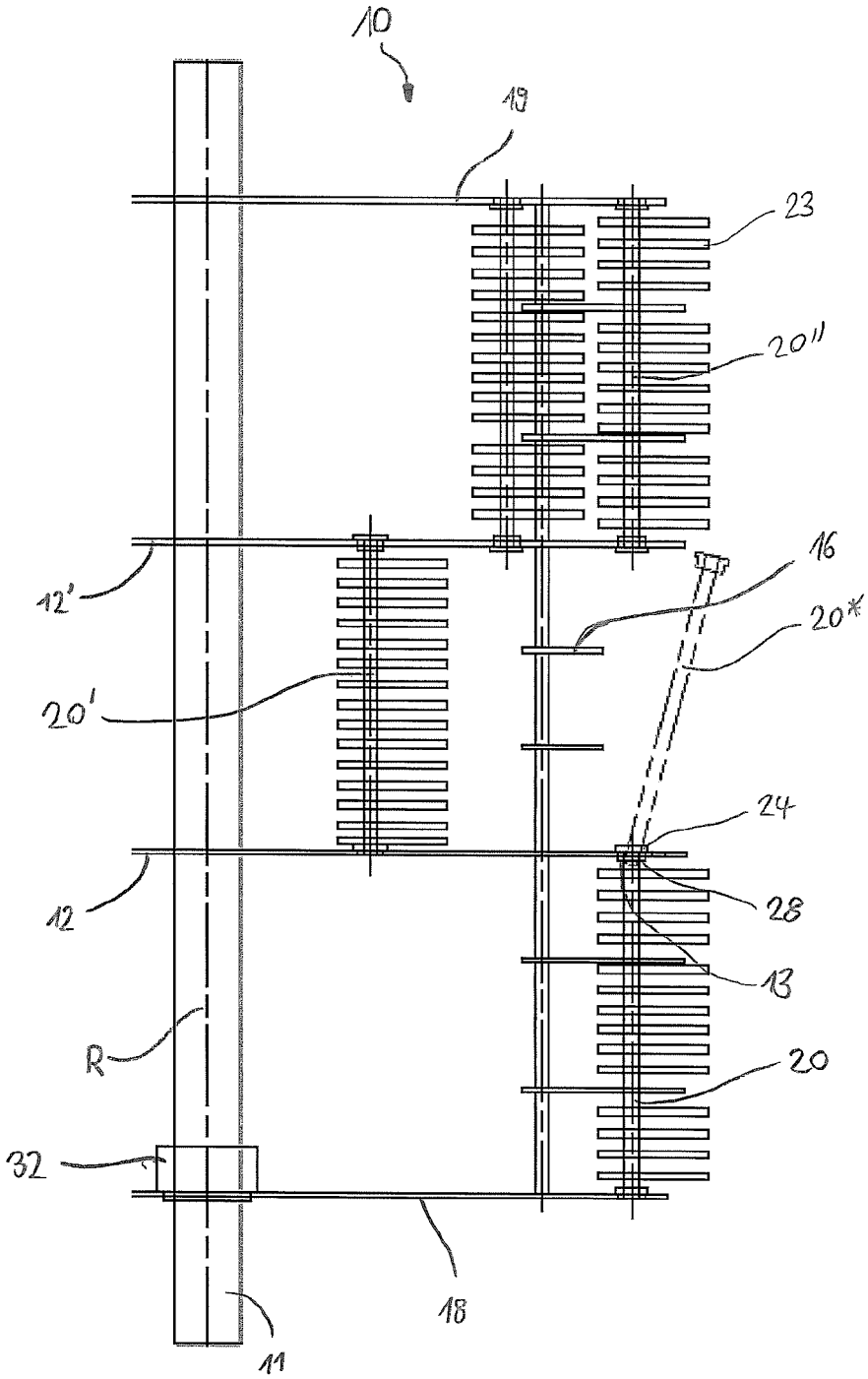
Figure 5:
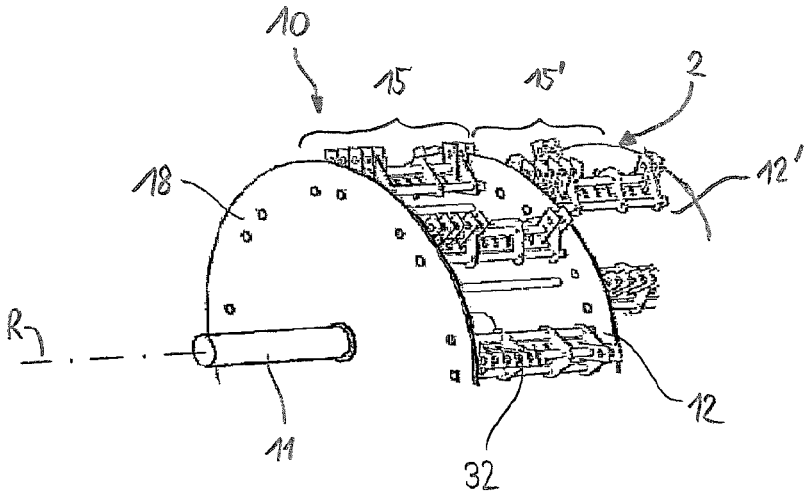
Figure 6:
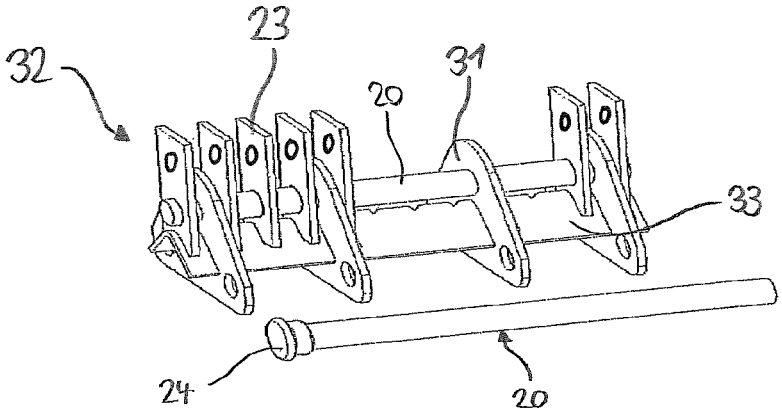
Figure 7:
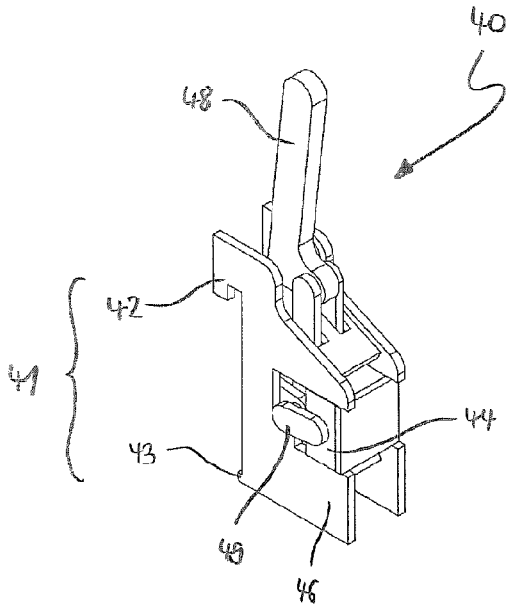
Figure 8A:
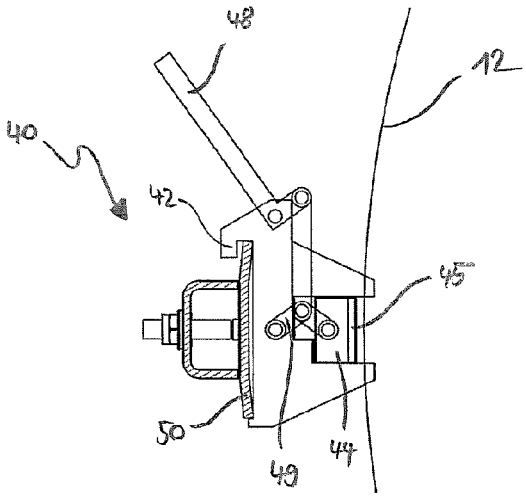
Figure 8B:
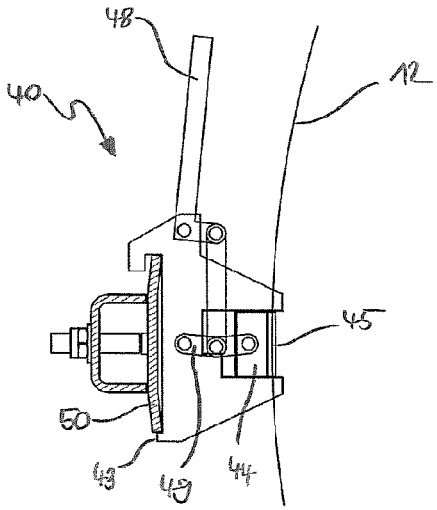
Figure 9:
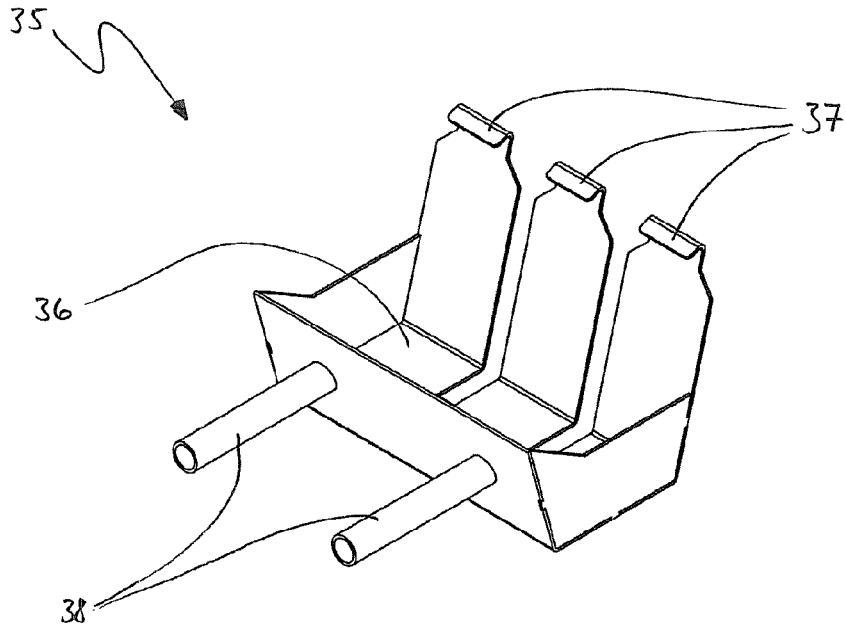
Figure 10:
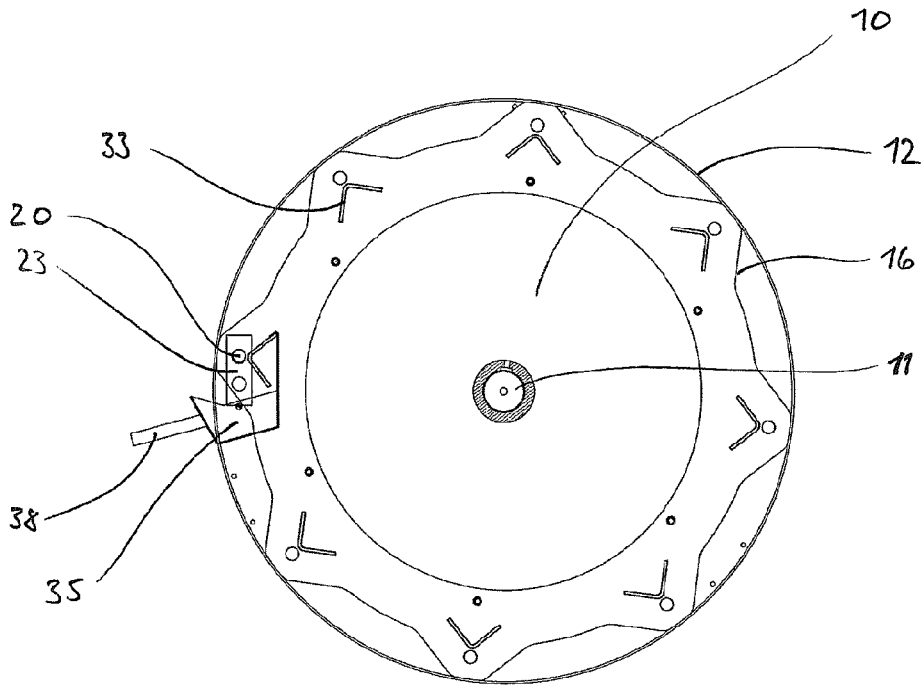
Figure 11:
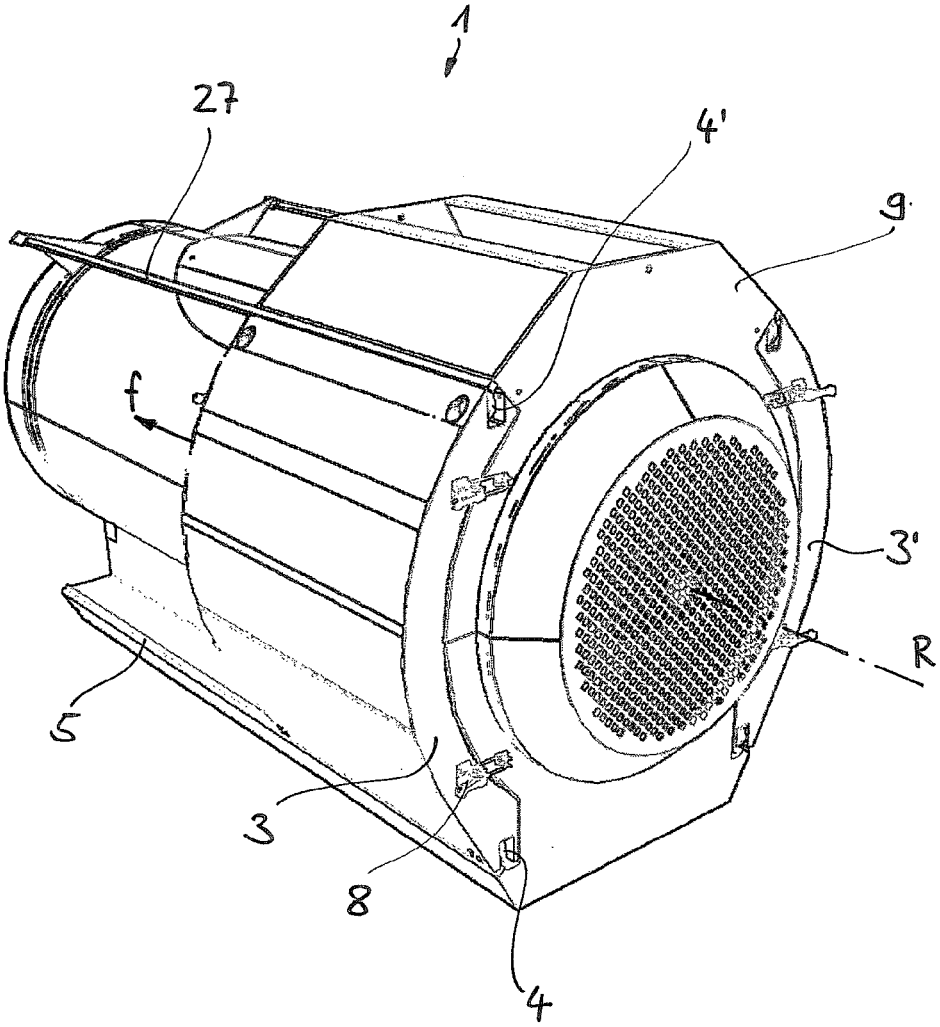
Figure 12:
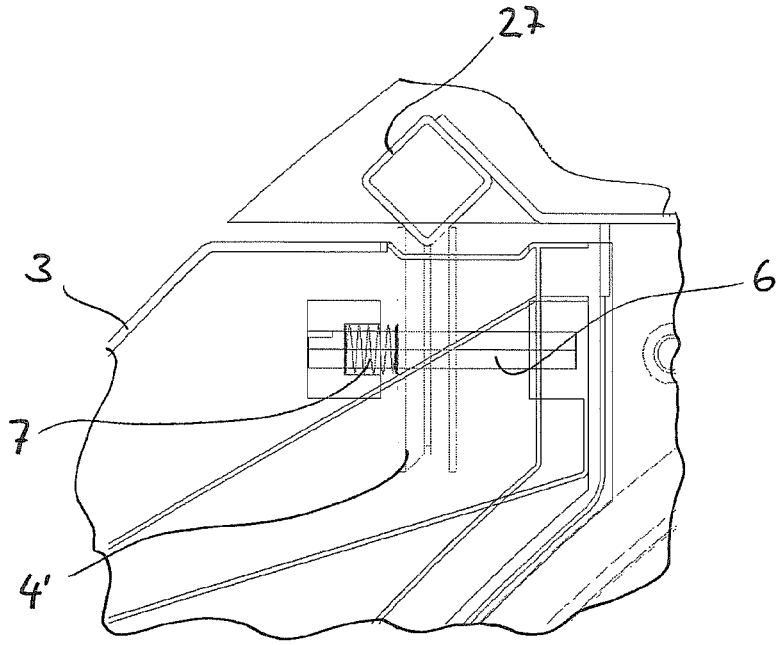
Figure 13:
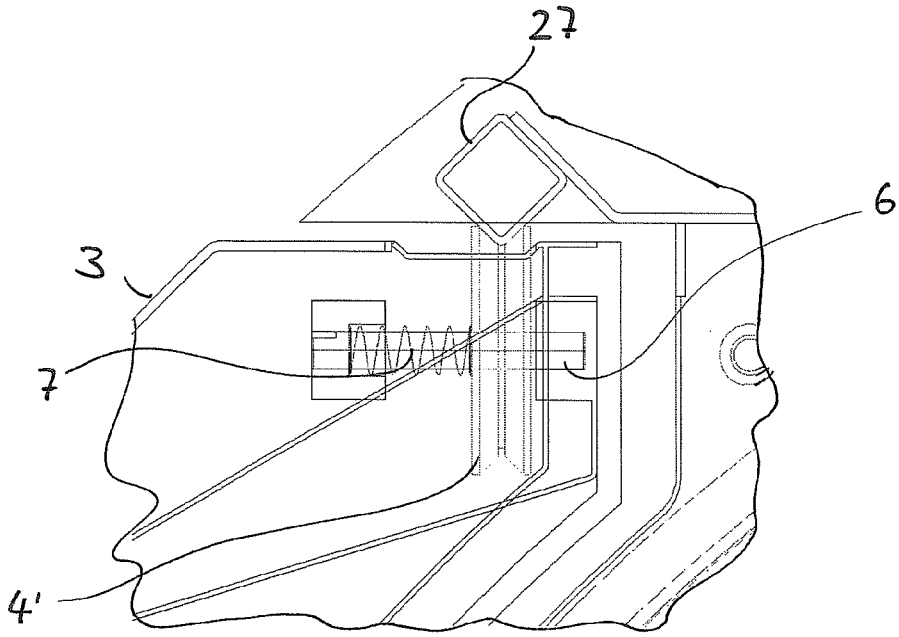

The invention will be explained in greater detail hereinafter on the basis of figures, which merely illustrate exemplary embodiments and in which:

FIG. 1: shows a perspective view of a hammer mill according to the invention;

FIG. 2: shows a perspective view of a rotor according to the invention;

FIG. 3*a*: shows a hammer pin according to the invention;

FIG. 3*b*: shows a further embodiment of a hammer pin according to the invention;

FIG. 4: shows a detail of a plan view of a rotor;

FIG. 5: shows a perspective view of another embodiment of a rotor according to the invention;

FIG. 6: shows a hammer assembly for the rotor according to FIG. 5;

FIG. 7: shows a perspective view of a fixing device;

FIG. 8*a*: shows a schematic side view of a loose fixing device in a grinding chamber of a hammer mill;

FIG. 8*b*: shows a schematic side view of the fixing device according to FIG. 8*a*, wherein the fixing device is tensioned;

FIG. 9: shows a perspective view of a catch device;

FIG. 10: shows a schematic side view of a rotor with a hung catch device;

FIG. 11: shows a perspective view of the hammer mill according to FIG. 1 from another direction;

FIG. 12: shows a sectional view taken along a roller shaft of a door of a hammer mill in the closed position; and FIG. 13: shows the sectional view according to FIG. 8, wherein the roller is located in the open position relative to the door.

FIG. 1 shows a hammer mill denoted on the whole by 1. The hammer mill 1 has a rotor (not illustrated) equipped with hammers. The rotor is located in a grinding chamber, which is surrounded by a housing 9. The housing 9 is designed in such a way that an undesired escape of the mill feed into the external environment is prevented during the operating phase. The drive for the rotor is located on the side of the hammer mill 1 facing the viewer.

For example, doors denoted by 3 are provided for servicing operations and can be displaced in the direction f for opening.

To this end, the door 3 has upper and lower rollers 4 and 4', which can be rolled over roller tracks 5 arranged parallel to the rotor shaft during the displacement movement. The roller track 5 assigned to the lower rollers 4 is clearly an integrated component of the machine table on which the hammer mill is installed. Two guide bars 27 extending parallel to the rotor axis R are provided for the upper rollers 4' and each define corresponding roller tracks. Furthermore, closing means 8 for securing the door 3 in a closed position can be seen in FIG. 1.

FIG. 11 shows a further illustration of the hammer mill 1. For example, it can be seen from this figure that the hammer mill 1 has two mutually opposed doors 3 and 3'.

FIG. 2 shows a first variant for a rotor 10 for the hammer mill. The rotor 10 has a rotor shaft 11 arranged coaxially with the rotor axis R. The rotor has two rotor discs defining end faces, the first of which (visible) is denoted by 18. The grinding chamber located between these rotor discs is indicated by 2. Two rotor discs are arranged between the end-face rotor discs, whereby the rotor is divided into three segments. Only the first segment 15 and (suggestively) the second segment 15' can be seen in the figure. Of course, the rotor could have three, four, or more segments, depending on the purpose. The arrangement of a single central rotor disc so as to define two segments is also conceivable, however.

Each segment has hammer pins distributed over the circumference. The hammer pins assigned to the first segment 15 are denoted by 20. The individual hammer pins 20 do not extend over all segments, but are assigned merely to the individual segments. For example, the first hammer pin 20 thus extends from the disc 18, merely as far as the directly adjacent rotor disc 12. The hammer pins 20 (and the hammer 23 mounted thereon) are arranged circumferentially on the rotor, offset slightly from the hammer pins of the adjacent segments. The individual hammer pins 20 are fastened releasably on both sides to mutually opposed rotor discs 12, 18, each defining an individual segment 15, 15'. A plurality of hammers 23 is located on each of the hammer pins. These hammers 23 have circular recesses, via which the hammers are mounted rotatably on the respective hammer pin, whereby an advantageous impacting or hammering motion is enabled during operation.

The hammers 23 are guided in "rakes" 33 so that they stay in their position on the hammer pins 20, even during operation, and maintain their uniform distribution between the rotor discs 19 and the support rings 16. These rakes 33 are connected directly to the rotor discs and the support rings 16 in the embodiment shown. The rakes 33 have slits, in which the hammers 23 can indeed rotate about the hammer pins 20, but are fixed with respect to lateral displacement.

The individual components of the rotor 10 preferably consist of metal materials, preferably of steel. For improved comprehension of the rotor structure, individual hammers on each hammer pin are not illustrated. Of course, it would be advantageous however, at least for normal grinding operation, if the rotor were equipped completely with hammers (in the present exemplary embodiment: 11 or 12 hammers per hammer pin; see FIG. 4). For example, the present rotor 1 has three segments with 24 hammer pins and (when equipped fully) 284 or 288 hammers.

Two support rings 16 are assigned to each segment 15, 15'. The support rings 16 have a reduced outer diameter in the region of the hammer pins of the adjacent segments, and therefore the hammer pins of an adjacent segment are not impeded by the support rings 16 when they are withdrawn. A stable and robust design is thus achieved, since the support rings 16 are connected to the rotor discs 18, 12 by means of support pins 17. In contrast to the hammer pins, the support pins 17 extend over the entire length of the rotor and thus cover all segments 15, 15'.

A first embodiment of an individual hammer pin 20 is illustrated in FIG. 3*a*. The hammer pin 20 consists of a cylindrical shaft having an outer diameter $D_a$. A cap 24 is arranged at one end of the hammer pin 20 on the end face thereof. The cap 24 has a bore corresponding to the outer diameter $D_a$ of the hammer pin 20. In the present exemplary embodiment according to FIG. 3*a*, the cap 24 is fixed on the hammer pin 20 via a fastening screw 29. For example, another screwed connection or another type of fastening may be selected for secure fastening of the cap 24 on the hammer pin 20. For example, the hammer pin 20 could have a corresponding outer thread at the end face and the bore 26 could have a corresponding inner thread at the end face. The cap 24 has a cylindrical portion having an outer diameter $d_i$, which corresponds to the opening 13 in the rotor disc 12.

The cap 24 is supported on one side by a circumferential collar defining a shoulder 25. To secure the mounted hammer pin 20, a groove 30 is arranged in the cap, into which a securing ring (illustrated in plan view in FIG. 3*a* and denoted by 28), in particular a snap ring, can be inserted. The difference between the two diameters $d_i$ and $D_a$ produces an annular gap when the hammer pin 20 is withdrawn from the opening 13 and enables tilting for easy removal. The advantages of this specific hammer pin construction can be seen with reference to FIG. 4.

FIG. 3*b* shows a further embodiment of a hammer pin 20'. The hammer pin again consists of a cylindrical shaft having an outer diameter $D_a$ (see FIG. 3*a*). In contrast to the embodiment according to FIG. 3*a*, a cap 24, 24' is arranged at both end faces of the hammer pin. These two caps 24, 24' again have a bore 26, 26' corresponding to the outer diameter $D_a$ of the hammer pin. On one side, the cap 24 is fixed to the hammer pin 20 via a fastening screw, identically to FIG. 3*a* (but without a securing ring arranged in a groove in the cap 24), whereas, on the other side, the hammer pin 20 is fastened in the cap 24' by means of a snap ring 28'. To this end, the hammer pin 20 has a circumferential groove 34, which receives the snap ring 28' and can be fitted into a groove 30' in the bore 26' in the cap 24'. It goes without saying that other variants, for example as described with reference to FIG. 3*a*, are possible for the two types of fastening of the caps 24, 24' on the hammer pin 20. Both caps 24, 24' again have a cylindrical portion having an outer diameter $d_i$ (see FIG. 3*a*), which corresponds to the opening 13 in the rotor disc 12.

One cap 24 again has a collar forming a shoulder 25 on one side, whereas the other cap 24' is fixed rigidly in the opening 13 in the rotor 12. For example, the cap 24' can be glued in, welded in or screwed in.

The difference between the diameter $d_i$ of the cap 24 and the diameter $D_a$ of the hammer pin 29 again makes it possible to tilt the hammer pin 20 when it is withdrawn from the opening 13 (see the description hereinafter with reference to FIG. 4).

The segment-like structure of the rotor is again clearly visible from the plan view according to FIG. 4. The respective hammer pins 20, 20' and 20" are clearly each only assigned to one segment. It can also be seen from FIG. 4 that, for example, the first hammer pin 20 extends only from the rotor disc 18 to the next rotor disc 12. Each hammer pin 20, 20' and 20" between each two adjacent support rings 16 and between a support ring 16 and an adjacent rotor disc 12, 12', 18, 19 clearly each receives a plurality of hammers 23.

For disassembly, for example for replacement of the hammers, the hammer pin 20 has to be withdrawn from the opening 13 in the rotor disc 12. Due to the adjacent rotor disc 12', the hammer pin 20 cannot be withdrawn completely however in the axial direction. Since tilting is possible due to the greater diameter $d_i$ (see FIG. 3*a*) of the opening 13 compared to the outer diameter $D_a$ (see FIG. 3*a*) of the hammer pin 20, the hammer pin can still be removed easily from the rotor after having been tilted. A hammer pin tilted in such a way is illustrated in a dashed manner and denoted by 20*. The support rings 16 have a reduced outer diameter in the region of the hammer pins 20, 20' and 20" of the adjacent segments, and therefore the hammer pin of an adjacent segment is not impaired by the support rings 16 as it is withdrawn. The individual rotor discs 12, 12', 18 and 19 are arranged at uniform distances from one another over the rotor shaft 11 and are each connected rigidly to the rotor shaft 11 by a flange-like retaining member 32.

FIG. 5 concerns a second variant for a rotor 10 according to the invention, which likewise is characterized by a segment-like structure. This rotor 10 basically differs from the previous exemplary embodiment in that entire hammer assemblies 32 are received between adjacent rotor discs instead of individual hammers 23.

A hammer assembly 32 of this type is illustrated in FIG. 6. The hammer assembly 32 clearly has triangular support members 31 for example, which provide stability. In addition to the hammers 23 and the support members 31, the hammer assemblies 32 also have a rake 33. This rake 33 is used to laterally guide and position the hammers, as described previously. In addition to a hammer assembly 32, a disassembled hammer pin 20 can also be seen in FIG. 6. This hammer pin 20 forms a unit together with the cap 24. Lastly, it can also be seen from FIG. 6 that each hammer 23 is provided with two circular recesses. When signs of wear start to show, the second recess makes it possible to assemble the hammer in a reverse position in the hammer assembly and thus be used further.

FIG. 7 illustrates a perspective view of a fixing device 40. The fixing device 40 basically has a main frame 46, a lever 48 and an engagement means 44. A gripping means 41 in the form of a hook 42 and a heel 43 is arranged on the main frame. The fixing device 40 can be hung by means of the hook 42 in the grinding chamber of a hammer mill from an accordingly designed connecting member. By operating the lever 48, the engagement means 44 can be displaced via the elbow lever 49, which, with suitable arrangement in the grinding chamber, leads to jamming of a rotor disc and thus fixing of the rotor.

FIGS. 8*a* and 8*b* show a schematic side view of the function of the fixing device 40 according to FIG. 7 in relation to a rotor disc 12. FIG. 8*a* shows the fixing device 40 in an idle position, whereas FIG. 8*b* shows the fixing device 40 in a locking position. The fixing device 40 is hung via its hook 42 from a wear rail 50 of the grinding chamber of the hammer mill. The heel 43 secures against accidental release. The elbow lever 49 can be moved by means of the lever 48, which in turn leads to displacement of the engagement means 44. The engagement means 44 can thus be displaced from an idle position (see FIG. 8*a*) into a locking position (see FIG. 8*b*), in which a clamping plate 45 arranged on the engagement means 44 is pressed against an edge of a rotor disc 12. The clamping plate 45 is fabricated from a hard rubber so that, during the clamping process, the rotor disc 12 is not damaged and optimal fixing of the rotor disc 12 is nevertheless ensured. Other materials of the clamping plate 45 are conceivable.

FIG. 9 shows a perspective view of an embodiment of a catch device 35 according to the invention. The catch device 35 basically has a trough-shaped catch chamber 36, which is provided with two handles 38 and three hook-shaped fastening elements 37. The catch space 36 and the fastening elements 37 of the catch device 35 are formed in one piece as a bent sheet metal component. Another design is also conceivable.

FIG. 10 illustrates a schematic side view of a catch device 35 and of a rotor 10. The rotor 10 is shown in simplified form, with merely the main elements being illustrated. The rotor 10 has a rotor shaft 11. A rotor disc 12 is fastened on the shaft. A support ring 16 is also illustrated. Rakes 33 distributed uniformly over the circumference of the rotor 10 are arranged on the rotor disc 12. Such a rake 33 is shown with a hammer 23 on a hammer pin 20. The catch device 35 is fastened to the rake 33 via its fastening elements. The catch device 35 is arranged in such a way that the hammer 23 is located directly above the catch chamber of the catch device 35. The handle 38, which enables easy positioning of the catch device 35, can be clearly seen.

FIGS. 12 and 13 each show a detailed illustration of the sliding door mechanism with upper rollers 4' in different positions. In FIG. 12, the door 3 is in a closed position. In this case, a pressing means 7 designed as a helical compression spring or as a spring assembly is clearly compressed, thus producing a bias. The rollers 4' are thus biased, on the roller shafts 6, into the open position by the pressing means 7. Displacement from the closed position is thus facilitated.

FIG. 13 shows the door 3 from FIG. 12 in an open position (relieved position). The closing means in the form of tension levers 8, as can be seen in FIGS. 1 and 11 and arranged on the door 3, enable displacement of the rollers into the closed position, against the force exerted by the pressing means 7.

The invention claimed is:

1. A hammer mill, comprising a grinding chamber, which can be closed during normal use, and a rotor arranged in the grinding chamber, said rotor comprising a rotor shaft, a plurality of rotor discs, which divide the rotor into a plurality of segments, and a plurality of hammer pins for receiving hammers or hammer assemblies wherein said hammer pins do not extend over all segments, wherein one or more support rings is/are arranged between each two adjacent rotor discs.

2. The hammer mill as claimed in claim 1, wherein the individual hammer pins are fastened releasably on both sides to mutually opposed rotor discs defining an individual segment.

3. The hammer mill as claimed in claim 1, wherein openings in the rotor discs for receiving the hammer pins have an inner diameter which is greater than an outer diameter of a hammer pin.

4. The hammer mill as claimed in claim 1, wherein the hammer pins of a segment are arranged offset from the hammer pins of an adjacent segment.

5. The hammer mill as claimed in claim 1, wherein the support rings are connected to the rotor discs by means of support pins.

6. The hammer mill as claimed in claim 5, wherein the support pins are continuous over all rotor discs.

7. The hammer mill as claimed in claim 1, wherein each hammer pin between each two adjacent support rings or between a support ring and an adjacent rotor disc receives at least one or more hammers.

8. The hammer mill as claimed in claim 1, wherein each hammer pin is provided at a first end with a cap for fastening the hammer pin in an opening in a rotor disc.

9. The hammer mill as claimed in claim 8, wherein the cap has a substantially cylindrical shape, which has a shoulder for support at a rotor disc and a bore to receive the hammer pin.

10. The hammer mill as claimed in claim 1, further comprising at least one door closing the grinding chamber, the door being mounted displaceably by means of rollers on a roller track arranged in particular parallel to a rotor axis, the rollers being mounted on roller shafts fastened to the door and extending perpendicular to the roller track, wherein the rollers are mounted axially displaceably on said roller shafts between an open position and a closed position.

11. The hammer mill as claimed in claim 10, wherein the rollers, on the roller shafts, are biased into the open position by a pressing means.

12. The hammer mill as claimed in claim 11, wherein the door has closing means, which allow displacement of the rollers into the closed position, against the force exerted by the pressing means.

13. A rotor for a hammer mill, said rotor comprising a rotor shaft, a plurality of rotor discs, which divide the rotor into a plurality of segments, and a plurality of hammer pins for receiving hammers or hammer assemblies, the rotor discs having openings for receiving the hammer pins, wherein said hammer pins do not reach over all segments , wherein one or more support rings is/are arranged between each two adjacent rotor discs.

14. A catch device for catching hammers of a rotor of a hammer mill, said catch device comprising a trough-shaped catch chamber, wherein the catch device has fastening elements for fastening the catch device between two rotor discs.

* * * * *